US006053133A

United States Patent [19]

Faria et al.

[11] Patent Number: 6,053,133

[45] Date of Patent: Apr. 25, 2000

[54] TAPPET FOR AN INTERNAL COMBUSTION ENGINE VALVE DRIVE

[75] Inventors: Christof Faria, Rottenbach; Gerhard Maas, Herzogenaurach, both of Germany

[73] Assignee: Ina Walzlager Schaeffler oHG, Germany

[21] Appl. No.: 09/101,613

[22] PCT Filed: Aug. 27, 1996

[86] PCT No.: PCT/EP96/03766

§ 371 Date: Jul. 31, 1998

§ 102(e) Date: Jul. 31, 1998

[87] PCT Pub. No.: WO97/26446

PCT Pub. Date: Jul. 24, 1997

[30] Foreign Application Priority Data

Jan. 18, 1996 [DE] Germany ..... 196 01 587

[51] Int. Cl.[7] ..... F01L 13/00; F01L 1/25; F01L 1/14

[52] U.S. Cl. ..... 123/90.16; 123/90.5; 123/90.55

[58] Field of Search ..... 123/90.15, 90.16, 123/90.17, 90.35, 90.48, 90.49, 90.5, 90.55

[56] References Cited

U.S. PATENT DOCUMENTS

| | | | |
|---|---|---|---|
| 5,351,662 | 10/1994 | Dopson et al. | 123/90.16 |
| 5,431,133 | 7/1995 | Spath et al. | 123/90.16 |
| 5,615,651 | 4/1997 | Miyachi | 123/90.16 |
| 5,651,335 | 7/1997 | Elendt et al. | 123/90.16 |

FOREIGN PATENT DOCUMENTS

| | | |
|---|---|---|
| 4210567 | 10/1992 | Germany . |
| 4221135 | 6/1993 | Germany . |
| 4232848 | 3/1994 | Germany . |
| 4314619 | 11/1994 | Germany . |
| 4329590 | 3/1995 | Germany . |
| WO 93/18284 | 9/1993 | WIPO . |
| WO 94/22543 | 11/1993 | WIPO . |

*Primary Examiner*—Wellun Lo
*Attorney, Agent, or Firm*—Bierman, Muserlian and Lucas

[57] ABSTRACT

A tappet (1) is made such that it can be coupled for different valve lifts. To assure a sufficiently rapid supply of hydraulic medium to the coupling means (10) of the tappet (1) in the base circle phase of the cam, according to the invention, the tappet (1) is in permanent hydraulic communication with a supply gallery (23). As a result of this, a pre-pressure of hydraulic medium already prevails in the reservoir (15) in front of the coupling means (10) immediately before the desired coupling, so that the desired coupling of the coupling means (10) can take place sufficiently rapidly even at high speeds of rotation of the internal combustion engine.

11 Claims, 3 Drawing Sheets

TAPPET FOR AN INTERNAL COMBUSTION ENGINE VALVE DRIVE

DESCRIPTION

1. Field of the Invention

The invention concerns a tappet for a valve train of an internal combustion engine for a valve train, which tappet (1) is installed in a bore (6) of a cylinder head (7) of an internal combustion engine and can be switched to different valve lifts for at least one gas exchange valve, said tappet (1) comprising an annular and a circular bottom section (2, 3) arranged concentrically to each other and contactable each one by a cam of different lift, the tappet (1) being guided in the bore (6) by a skirt (4) connected to the annular bottom section (2), said annular and circular bottom sections (2, 3) being dispaceable relative to each other and adapted to be coupled to each other in the region of their common annular plane (8) by coupling means (10) which are displaceable radially or secant-like by a servo medium at least in a first direction of displacement, the skirt (4) comprising at least one inlet (25) for the servo medium, which inlet (25) serves to convey the servo medium from one end (22) of a supply gallery (23) which intersects the bore (6) of the cylinder head (7) to a reservoir (15) arranged in at least one of the bottom sections (2, 3).

2. Background of the Invention

Such a tappet is known for example from EP-OS 06 20 36. A drawback of this tappet is that its hydraulic medium supply paths are situated in the bore of the cylinder head. This requires complicated modifications to cylinder heads of known design or an expensive manufacture of these paths in the cylinder heads. At the same time, due to their height, it is not guaranteed that the coupling means can be permanently supplied with hydraulic medium. Besides this, the prior an contains no suggestion for a person skilled in the art as to how the switching operation of the coupling means can be accelerated. Under unfavorable conditions, it is possible, especially at high engine speeds that the available switching time window is not sufficient to build up the pressure required for a displacement of the coupling means in the reservoir concerned, Since, as a rule, such coupling means are reset by mechanical spring means, it is only the short time interval "cam base circle" that is available to the spring means to reset the coupling means with falling servo medium pressure by pressing the servo medium back into the gallery At the same time, according to EP-OS 06 20 360, a separate path leading from the cylinder head is provided for a hydraulic medium supply to a hydraulic clearance compensation clement arranged in the tappet. This separate path in the cylinder head necessitates separate oil ducts in the tappet concerned. This likewise increases the costs of manufacture both of the cylinder head and the tappet.

OBJECT OF THE INVENTION

It Is therefore the object of the invention to create a tappet of the initially cited type in which the mentioned drawbacks are eliminated and a low-wear switching is permitted even at high engine speeds, particularly with the use of simple means.

SUMMARY OF THE INVENTION

The tappet of the invention for a valve train, which tappet is installed in a bore of a cylinder head of an internal combustion engine and can be switched to different valve lifts for at least one gas exchange valve, said tappet comprising an annular and a circular bottom section arranged concentrically to each other and contactable each one by a cam of different lift, the tappet being guided in the bore by a skirt connected to the annular bottom section, said annular and circular bottom sections being displaceable relative to each other and adapted to be coupled to each other in the region of their common annular plane by coupling means which are displaceable radially or secant-like by a servo medium at least in a first direction of displacement, the skirt comprising at least one inlet for the servo medium, which inlet serves to convey the servo medium from one end of a supply gallery which intersects the bore of the cylinder head to a reservoir arranged in at least one of the bottom sections, is characterized in that a path to the inlet is created on or in the outer peripheral surface of the skirt, an extent of the path is such that the path is in hydraulic communication with the end of the supply gallery during an entire stroke of the tappet or during a substantial part of the stroke of the tappet.

The features create a permanent supply of the tappet described here with servo medium. At the same time, no complicated modifications to cylinder heads of known design are required because the supply paths concerned are arranged in the skirt of the switchable tappet. The servo medium is preferably a hydraulic medium. However, air or brake fluid and the like are also proposed as servo media and covered by the scope of protection of the invention. Consequently, for the hydraulic displacement of the coupling means, for example, the reservoir can be pre-pressurized already before the actual coupling phase, so that in the subsequent base circle phase, this pre-pressure can be utilized for a faster displacement of the coupling means. This results in a drastic reduction of the time required for building up the necessary pressure in the reservoir. A tappet which is permanently supplied with a servo medium is equally advantageous also for a mechanical resetting of the coupling means in opposition to the falling pressure medium pressure because the entire tappet stroke is available for the reduction of pressure. In place of mechanical means it is also possible to use magnetic, electromagnetic or indirectly mechanically actuated means and the like. It is equally possible to replace the servo medium with these means.

The invention applies equally to switchable tappets whose two bottom sections are coupled by spring force in the absence of servo medium pressure and to switchable tappets in which a coupling of the two sections is achieved by coupling means pressurized by servo assistance.

The required permanent supply of pressure medium to the tappet is advantageously achieved according to the invention by a depression such as a bead extending in longitudinal direction on the outer peripheral surface of the skirt of the tappet, which depression, due to a securing of the tappet against rotation, is permanently supplied with pressure medium from one end of a supply gallery of the cylinder head. Advantageously, this depression is made in the skirt of the tappet without chip removal, but cutting procedures may also be used. The depression can comprise a cam-proximate inlet on the skirt, which inlet communicates directly with the reservoir, but this inlet may also be arranged at a cam-remote position on the skirt, in which case, a channel leading to the reservoir extends on the inner peripheral surface of the skirt.

In an embodiment alternative to the previous one, the skirt comprises at least one axially extending aperture which communicates with the end of the supply gallery of the cylinder head and comprises in its upper region, an inlet into the reservoir of the annular bottom section.

Advantageously, the reservoir of the annular bottom section is delimited in cam-distal direction by an annular element extending on the inner peripheral surface of the skirt and comprising a radially outer axial extension which extends on and is fixed to the inner peripheral surface of the skirt. Radially inwardly, the annular element can also be bent, for example, axially in a cam-distal direction and bear sealingly against an axial extension of the annular bottom section.

A simple anti-rotation device for the tappet relative to its reception bore in the cylinder head comprises, according to the invention, for example, a cylinder such as a roller needle arranged In the skirt of the annular bottom section. However, it is also conceivable and within the scope of the invention to use bodies of any kind which project axially outwards from the skirt and engage a recess of the cylinder head. For the same purpose, it is likewise conceivable to arrange an anti-rotation device locked in place in the cylinder head and extending into a complementary longitudinal recess of the skirt.

According to the invention, the tappet is provided with a hydraulic clearance compensation element. This enables the omission of complicated mechanical valve clearance adjusting measures during the operation of the internal combustion engine. In this connection, it is particularly simple to provide a common supply from the supply gallery In the cylinder head to the coupling means and the hydraulic clearance compensation element in the tappet. However, it is also possible to arrange separate supply ducts in the tappet starting from the cylinder head.

Advantageously, the coupling means are configured as radially displaceable pistons which extend in corresponding receptions of the annular and circular bottom sections.

According to the invention, it is further possible to retain the pistons acting as coupling means, for example, in receptions of the circular bottom section by the force of tension springs and to displace them radially outwards for coupling into corresponding receptions of the annular bottom section by the servo medium.

Further, as already mentioned above, the method describe appropriate method steps for the pressurizing and pressure-relieving of the reservoir, but the scope of the invention also includes method steps which do not concern the entire time period stated in the claims. At the same time, these claims also pertain to switchable tappets which are supplied with hydraulic medium by means other than the described paths, for example, through paths in the bores of the cylinder head.

BRIEF DESCRIPTION OF THE DRAWINGS

The invention is represented in the drawings which show.

DETAILED DESCRIPTION OF THE DRAWINGS

Figure 1:
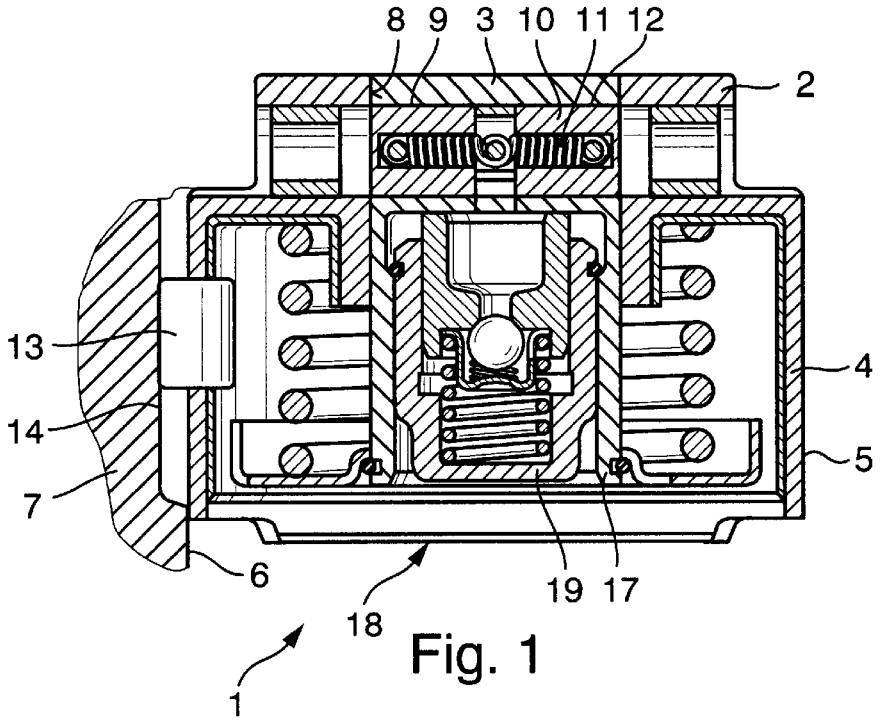
FIG. 1, a longitudinal section through a tappet of the invention in the region of the coupling means, FIG. 2, a tappet according to FIG. 1 but in a sectional view turned through 90°, and a depression forming a hydraulic medium path on the skirt, FIG. 3, a similar embodiment in a view corresponding to the previous one, FIG. 4, a top view of a tappet according to FIG. 3 with partial views of the hydraulic medium path, and FIG. 5, an alternative to the above-mentioned embodiments, having an aperture in the skirt forming a hydraulic medium path.

Only such features of the tappet as are important for the description of the invention will be described here because a tappet of the type concerned is sufficiently well-known in the technical field (see, for example, DE-OS 43 14 619).

The tappet 1 comprises an annular and a circular bottom section 2, 3. The annular bottom section 2 is loaded by at least one cam, not shown, having a large lift, and the circular bottom section 3 situated adjacent thereto is loaded by a cam having a smaller or zero lift. Radially outwardly, the annular bottom section 2 comprises a thin-walled skirt 4 extending in cam-distal direction. The tappet 1 extends with an outer peripheral surface 5 of the skirt 4 in a bore 6 (see also FIG. 2) of a cylinder head 7. The two bottom sections 2, 3 are displaceable relative to each other in the region of their common annular plane 8. The circular bottom section 3 comprises a reception 9 within which coupling means 10 configured as pistons extend with their entire length in the uncoupled state of the two sections 2, 3. Each coupling means 10 is retained radially inwards (further direction of displacement) by the force of a tension spring 11. The coupling means 10 can be displaced radially outwards in a first direction of displacement by servo assistance, for example, by hydraulic medium pressure, into a complementary reception 12 of the annular bottom section 2. In this state of coupling, the tappet 1 follows the lift of the cam which loads the annular bottom section 2, while, otherwise, the tappet 1 executes only a stroke in response to the lift of the cam which loads the circular bottom section 3.

A person with knowledge in the technical field will also see from FIG. 1 that an anti-rotation device 13 in the form of a cylinder is fixed in the skirt 4. This anti-rotation device 13 extends in a complementary longitudinal groove 14 of the bore 6 of the cylinder head 7.

Figure 2:
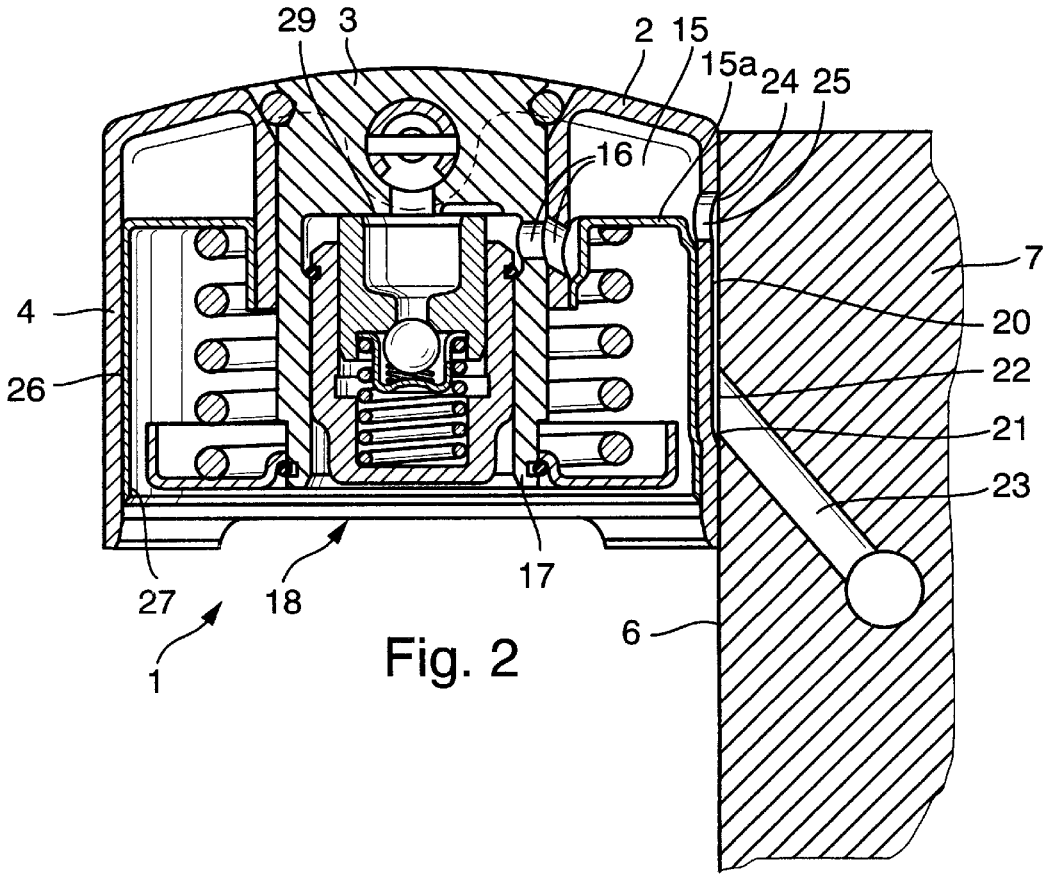

The sectional view of FIG. 2 additionally shows that the annular bottom section 2 comprises an annular reservoir 15 for hydraulic medium, which reservoir is delimited in cam-distal direction by an annular element 15*a*. Radially inwardly of this reservoir 15, a hydraulic medium channel 16 leading from the reservoir 15 to the coupling means 10 and to a hydraulic clearance compensation element 18 is formed by a guide sleeve 17 which extends from the circular bottom section 3 in cam-distal direction. This clearance compensation element 18 cooperates through its pressure piston 19 with an end of a gas exchange valve, not shown.

As shown in FIG. 2, a longitudinally extending depression 20 is arranged on the outer peripheral surface 5 of the skirt 4 to form a path for hydraulic medium. In the base circle phase of the cam, this depression 20 is in hydraulic communication through its lower end 21 with an end 22 of a hydraulic medium supply gallery 23. The length of the depression 20 is such that the depression 20 is in hydraulic communication with the end 22 during the entire cam lift. The depression 20, which can be made, for examples, as a bead, comprises at its upper end 24, an inlet 25 for hydraulic medium. Thus the tappet 1 is adequately supplied with hydraulic medium from the supply gallery 23 during its entire stroke. If, now, for example, a hydraulic, radially outwards displacement of the coupling means 10 for a coupling of the two sections 2, 3 is desired, d hydraulic medium pre-pressure is built up in the reservoir 15 with a commencing run-on phase of the cam immediately before the desired point of time of coupling. When the base circle phase of the cam in which the coupling of the two sections 2, 3 is to be effected is reached, this pre-pressure together with the still existing full hydraulic medium pressure is fully sufficient to displace the coupling means 10 at a high speed into the corresponding receptions 12. It is, however, likewise conceivable, to also provide, in a manner not specified here, longitudinal grooves in the region of the hydraulic medium channel 16, through which grooves hydraulic medium pressure can be conveyed to the coupling means 10 already in the afore-mentioned cam lift phase.

In an analogous manner, the reservoir 15 can be relieved of pressure medium pressure with a commencing run-on phase of the cam immediately before a desired uncoupling of the two sections 2, 3, so that in the subsequent base circle phase, because of the low hydraulic medium pressure acting on the coupling means 10, these coupling means 10 can be pulled Into their uncoupling position by the force of their springs. It is understood that such a permanent hydraulic supply of the reservoir 15 is also possible if the required supply paths are arranged in longitudinal grooves of the cylinder head and communicate with corresponding transfer opening; in the skirt 4, and said permanent hydraulic supply can likewise be implemented in switchable support elements for cam followers.

Figure 3:
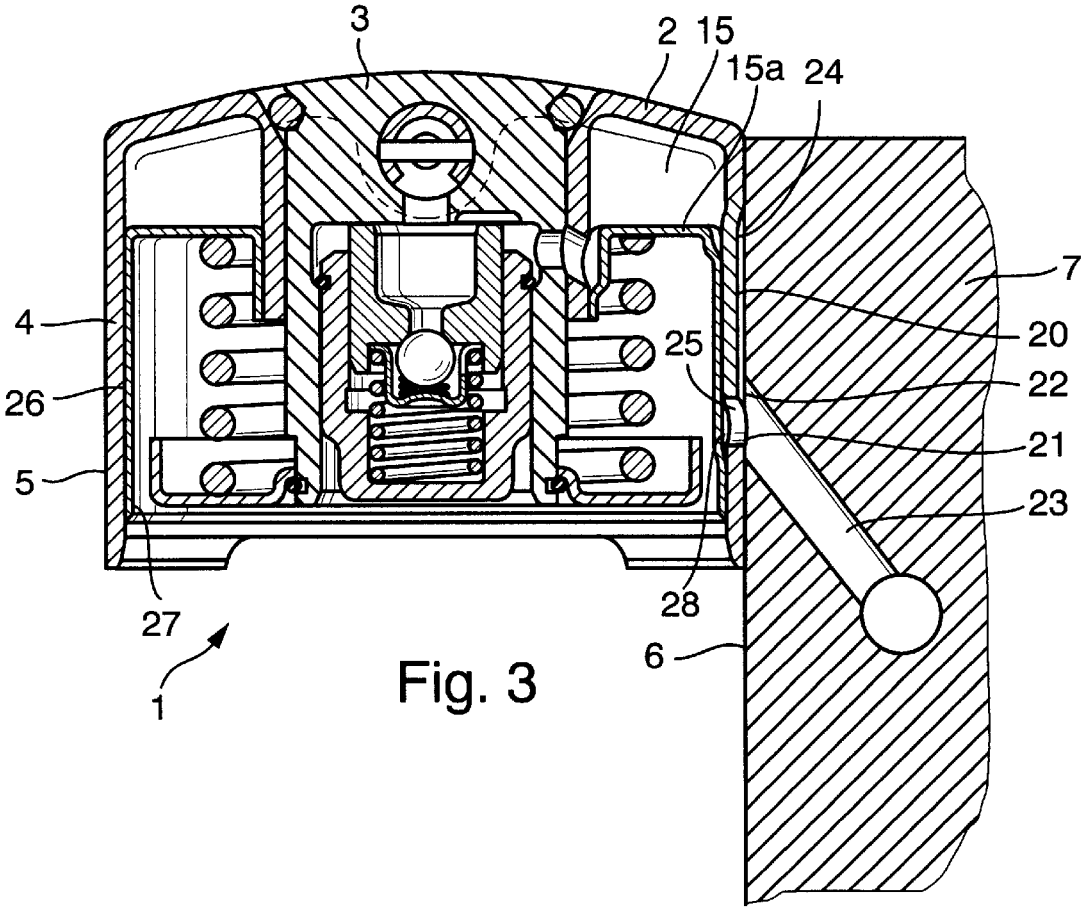

FIG. 3 shows an alternative to the preceding embodiment. The path 20 is again made as a depression but the further transport of hydraulic medium from the path 20 is realized in this case on an inner peripheral surface 26 of the skirt 4. For this purpose, a radially outer extension 27 of the annular element 15*a* extends on the inner peripheral surface 26 of the skirt 4 in cam-distal direction. A channel 28 (see also FIG. 4) starting from the lower end 21 of the depression 20 extends between the inner peripheral surface 26 and the axial extension 27 towards the reservoir 15. As can likewise be seen in FIG. 4, this channel 28 can also be arranged slightly offset in peripheral direction to the inlet 25.

Figure 5:
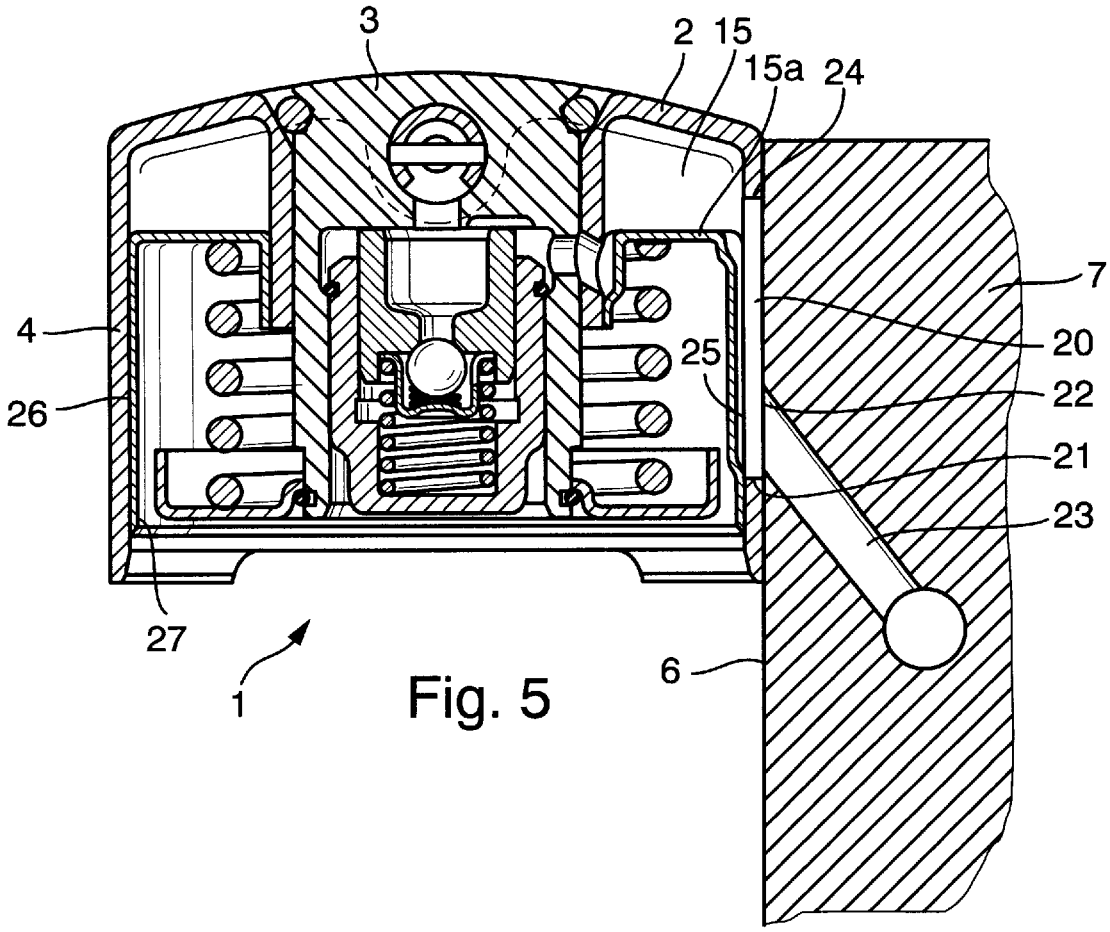

Finally, FIG. 5 shows a configuration of the path 20 as an alternative to the already described figures. In this case, the path 20 is made as an aperture in the skirt 4. This aperture again communicates at its lower end 21 with the end 22 of the supply gallery 23. The inlet 25 into the reservoir 15 is arranged in the region of the upper end 24. In axial direction, the upper end 24 of tile inlet 25 is situated above the annular element 15*a*, The axial extension 27 again extends circumferentially on the inner peripheral surface 26 of the skirt 4 and thus overlaps the aperture 20 radially,

We claim:

1. A method of servo assisted displacement of the coupling means (10) of a tappet (1) for a valve train, which tappet (1) is installed in a bore (6) of a cylinder head (7) of an internal combustion engine and can be switched to different valve lifts for at least one gas exchange valve, said tappet (1) comprising an annular and a circular bottom section (2,3) arranged concentrically to each other and contactable each one by a cam of different lift, the tappet (1) being guided in the bore (6) by a skirt (4) connected to the annular bottom section (2), said annular and circular bottom sections (2,3) being displaceable relative to each other and adapted to be coupled to each other in the region of their common annular plane (8) by coupling means (10) which are displaceable radially by a servo medium at least in a first direction of displacement, the skirt (4) comprising at least one inlet (25) for the servo medium, which inlet (25) serves to convey the servo medium from one end (22) of a supply gallery (23) which intersects the bore (6) of the cylinder head (7) to a reservoir (15) arranged in at least one of the bottom sections (2,3) wherein a path (20) to the inlet (25) is created on or in the outer peripheral surface (5) of the skirt (4), an extent of the path (20) is such that the path (20) is in hydraulic communication with the end (22) of the supply gallery (23) during at least part of the stroke of the tappet (1), the method of displacement of the coupling means in the first direction of displacement, comprising a first step in which, prior to the first direction of displacement, the reservoir (15) is provided with a pre-pressure of servo medium during the entire time interval between a commencing valve lifting phase of the cam and a subsequent base circle phase of the cam, and a further step in which, in the subsequent base circle phase of the cam, the reservoir (15) is provided with the full, hydraulically required displacing pressure.

2. The method of claim 1 wherein the path (20) is formed by a depression extending essentially longitudinally on the outer peripheral surface (5) of the skirt (4), a lower end (21) of the depression communicates with the end (22) of the supply gallery (23) and an upper end (24) of the depression communicates with the inlet (25) in the skirt (4), the inlet (25) opens directly into said reservoir (15), and the tappet (1) is guided secured against rotation in the bore (6) in the cylinder head (7) (FIG. 2).

3. The method of claim 1 wherein the reservoir (15) in the annular bottom section (2) is delimited in a cam-distal direction by an annular element (15*a*) attached to an inner peripheral surface (26) of the skirt (4).

Figure 4:
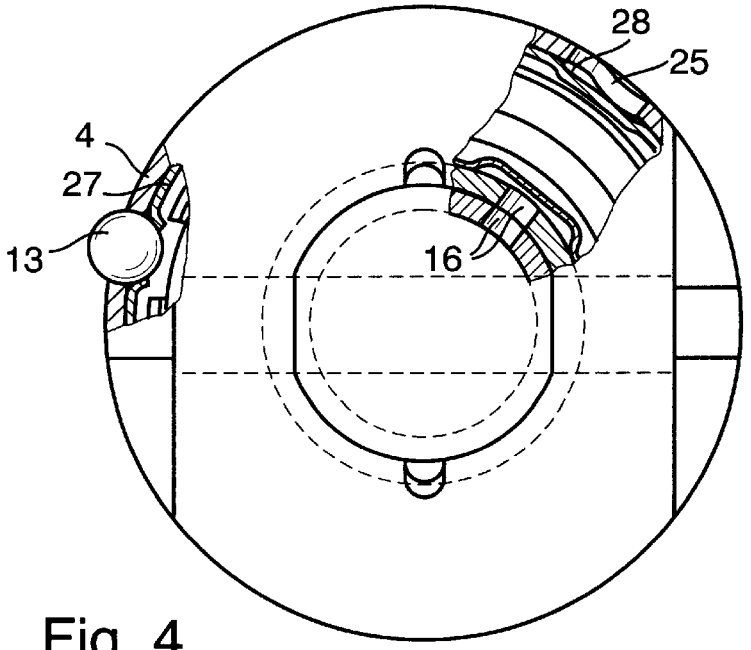

4. The method of claim 1 wherein path (20) is formed by a depression extending generally longitudinally on the outer peripheral surface (5) of the skirt (4), a lower end (21) of the depression communicates with the end (22) of the supply gallery (23), and the inlet (25) is arranged in this region in the skirt (4), the reservoir (15) is delimited by an annular element (15*a*) attached to the inner peripheral surface (26) of the skirt (4), which annular element (15*a*) is fixed radially outwardly on the inner peripheral surface (26) of the skirt (4) by an axial extension (27) extending in a cam-distal direction, a channel (28) starting from the inlet (25) is formed in the axial extension (27) and leads to the reservoir (15), and the tappet (1) is guided secured against rotation in the bore (6) of the cylinder head (7) (FIGS. 3, 4).

5. The method of claim 1 wherein the path (20) is formed by an aperture extending essentially longitudinally on the outer peripheral surface (5) of the skirt (4), a lower end (21) of the aperture communicates with the end (22) of the supply gallery (23), the reservoir (15) in the annular bottom section (2) being delimited in cam-distal direction by an annular element (15*a*) attached to the inner peripheral surface (26) of the skirt (4), which annular element (15*a*) is fixed radially outwardly against the inner peripheral surface (26) of the skirt (4) by an axial extension (27) which extends in a cam-distal direction and delimits the path (20) radially inwardly, an upper end (24) of the aperture being situated axially above the annular element (15*a*), so that the inlet (25) is formed between the two elements (15*a*, 24), and the tappet (1) is guided secured against rotation in the bore (6) of the cylinder head (7) (FIG. 5).

6. The method of claim 2 wherein an anti-rotation device (13) in the skirt (4) is formed by at least one cylinder projecting radially outwards from the skirt (4) and extending in a complementary longitudinal groove (14) of the cylinder head (7).

7. The method of claim 1 wherein the circular bottom section (3) comprises on an end face (29) remote from the cam, a guide sleeve (17) comprising a hydraulic clearance compensation element (18) which cooperates with at least one gas exchange valve.

8. The method of claim 7, wherein starting from the reservoir (15), a common supply of hydraulic medium to the coupling means (10) and the clearance compensation element (18) is created in the tappet (1).

9. The method of claim 1 wherein the coupling means (10) are pistons which, in the uncoupled state of the elements (2, 3) extend in a reception (9) in the circular bottom section (3) and, for coupling, can be displaced radially outwards into a reception (12) of the annular bottom section (2) by servo medium pressure acting in opposition to a tension spring force.

10. The method of claim 2 wherein the depression (20) is made in the form of a bead.

11. A method of displacement of the coupling means (10) of a tappet (1) for a valve train, which tappet (1) is installed in a bore (6) of a cylinder head (7) of an internal combustion engine and can be switched to different valve lifts for at least one gas exchange valve, said tappet (1) comprising an annular and a circular bottom section (2,3) arranged concentrically to each other and contactable each one by a cam of different lift, the tappet (1) being guided in the bore (6) by a skirt (4) connected to the annular bottom section (2), said annular and circular bottom sections (2,3) being displaceable relative to each other and adapted to be coupled to each other in the region of their common annular plane (8) by coupling means (10) which are displaceable radially by a servo medium at least in a first direction of displacement, the skirt (4) comprising at least one inlet (25) for the servo medium, which inlet (25) serves to convey the servo medium from one end (22) of a supply gallery (23) which intersects the bore (6) of the cylinder head (7) to a reservoir (15) arranged in at least one of the bottom sections (2,3) wherein a path (20) to the inlet (25) is created on or in the outer peripheral surface (5) of the skirt (4), an extent of the path (20) is such that the path (20) is in hydraulic communication with the end (22) of the supply gallery (23) during at least part of the stroke of the tappet (1), the method of displacement of the coupling means in a further direction of displacement by a mechanical spring means (11) comprising a first step in which, prior to the further direction of displacement, the reservoir (15) is at least partly relieved of servo medium pressure during the entire time interval between a commencing valve lifting phase of the cam and a subsequent base circle phase of the cam, and a further step in which, in the subsequent base circle phase of the cam, the reservoir (15) is completely relieved of the servo pressure required for displacement.

* * * * *